US005344670A

United States Patent [19]

Palmer et al.

[11] Patent Number: 5,344,670

[45] Date of Patent: Sep. 6, 1994

[54] SYSTEM FOR APPLYING CHEMILUMINESCENT FLUID TO AN OBJECT

[75] Inventors: Stephen L. Palmer; William R. Palmer, both of Cameron Park, Calif.

[73] Assignee: Sierra Innotek, Inc., Cameron Park, Calif.

[21] Appl. No.: 94,706

[22] Filed: Jul. 22, 1993

[51] Int. Cl.[5] ..... F21K 2/00; B05B 5/00

[52] U.S. Cl. ..... 427/157; 362/34; 427/256; 427/429

[58] Field of Search ..... 427/256, 157, 429; 362/34

[56] References Cited

U.S. PATENT DOCUMENTS 3,584,211 6/1971 Rauhut ..... 362/34
3,683,336 8/1972 Brownlee ..... 427/157
3,751,846 8/1973 Benjamin, Sr. .
3,813,534 5/1974 Gilliam ..... 240/2.25
4,814,949 3/1989 Elliott ..... 362/34
5,158,349 10/1992 Holland et al. ..... 362/34

*Primary Examiner*—Janyce Bell
*Attorney, Agent, or Firm*—Thomas R. Lampe

[57] ABSTRACT

Apparatus and method for applying a chemiluminescent fluid to an object. Two chemiluminescent fluid components are mixed within a reservoir. The mixed chemiluminescent fluid then flows through a porous applicator element mounted in a passageway in communication with the reservoir interior. The porous applicator element is in the form of a writing nib which may be utilized to manually apply the chemiluminescent fluid to an object.

11 Claims, 2 Drawing Sheets

SYSTEM FOR APPLYING CHEMILUMINESCENT FLUID TO AN OBJECT

TECHNICAL FIELD

This invention relates to an apparatus and a method for applying a chemiluminescent fluid to an object. The invention is applicable, for example, to the application of chemiluminescent fluids to clothing and other objects.

BACKGROUND ART

It is well known in the prior art to provide devices which emit chemiluminescent light responsive to mixing of two or more components. Such devices can be utilized for both practical and ornamental purposes. Commonly, the chemiluminescent fluid components are retained in a tube or other container after mixing. Exemplary of such products are the devices and materials disclosed in the following U.S. Pat. Nos.: 5,158,349, issued Oct. 27, 1992, U.S. Pat. No. 4,814,949, issued Mar. 21, 1989, U.S. Pat. No. 3,813,534, issued May 28, 1974, and U.S. Pat. No. 3,751,846, issued Aug. 14, 1973. These are merely representative of the prior art and many different chemiluminescent chemicals have been employed to produce chemiluminescence.

U.S. Pat. No. 3,584,211, issued Jun. 8, 1971, discloses a device for providing chemiluminescent light from a chemical reaction of suitable compounds including a fluorescent compound. The device illustrated in the patent may be utilized as either a self-contained light unit or a chemiluminescent dispensing unit and includes an outer tube. Bending the flexible, light-transmitting outer tube containing one chemiluminescent component breaks a frangible inner container holding a second component, allowing the substances to react.

The patent states that the luminescent reaction product may be dispensed and used as a luminescent marker or held in the closed device for use as an illumination wand. With regard to the dispensing approach, the patent discloses an outer tube having an opening through which the chemiluminescent material can be poured or squeezed by the user onto a surface. Two different embodiments are disclosed and both have the same deficiencies. Utilizing the approaches of U.S. Pat. No. 3,584,211, the user has no positive control over the amount of material to be dispensed. In other words, either an excess or deficiency of product dispensed is highly probable, making the device relatively unsuited to the decoration of clothing and other objects. Furthermore, there is always the danger that material from the ruptured or broken inner container or capsule will itself be dispensed along with the liquid. This can be particularly harmful if the ruptured inner container or capsule is formed of glass, as is common in chemiluminescent light sticks, wands, and other similar devices.

DISCLOSURE OF INVENTION

The present invention relates to both an apparatus and method which allow for the controlled application of a chemiluminescent fluid to an object such as clothing, signage or packaging materials. Furthermore, the present invention ensures precise application of the fluid at a desired location or locations on the object since the apparatus must be in actual engagement with the object for such application. The system also ensures that broken portions of the inner capsule or container employed to hold one of the chemiluminescent fluid components do not leave the reservoir of the apparatus. Thus, there is no danger that potentially harmful material such as broken glass will be dispensed.

The apparatus of the present invention is for applying a chemiluminescent fluid to an object. The apparatus includes reservoir means including a wall and defining an interior for holding a first component of a chemiluminescent fluid. The reservoir means additionally defines a passageway in communication with the reservoir means interior.

Capsule means is located within the reservoir means interior for holding a second component of the chemiluminescent fluid, the capsule means being frangible to release the second component of chemiluminescent fluid from the capsule means and bring the second component of chemiluminescent fluid into engagement with the first component of chemiluminescent fluid and allow mixing thereof in the reservoir means interior.

A porous applicator element is mounted in the passageway for receiving chemiluminescent fluid from the reservoir means interior and for applying the chemiluminescent fluid to an object after mixing of the first and second components of chemiluminescent fluid in the reservoir means.

Closure means is releasably attached to the reservoir means for maintaining the porous applicator element and the reservoir means interior isolated from the ambient atmosphere.

The porous applicator element comprises a porous writing nib having a distal end for engaging an object to apply chemiluminescent fluid to the object, the distal end being spaced from the reservoir means.

According to the method of the present invention, a first component of a chemiluminescent fluid is maintained in a confined space.

A second component of the chemiluminescent fluid is also maintained in the confined space and isolated from the first component.

The shape of the confined space is changed and the first and second components are substantially simultaneously brought into engagement. The first and second components are fixed in the confined space to form a mixed chemiluminescent fluid.

The next step comprises flowing the mixed chemiluminescent fluid through a porous writing nib communicating with the confined space and having a distal end to deliver the mixed chemiluminescent fluid to the distal end.

The distal end of the porous writing nib is brought into engagement with an object. Relative movement is effected between the object and the porous writing nib while maintaining engagement between the porous writing nib and the object to apply the mixed chemiluminescent fluid to the object in a desired pattern.

Other features, advantages, and objects of the present invention will become apparent with reference to the following description and accompanying drawings.

BEST MODE FOR CARRYING OUT THE INVENTION

Figure 4:
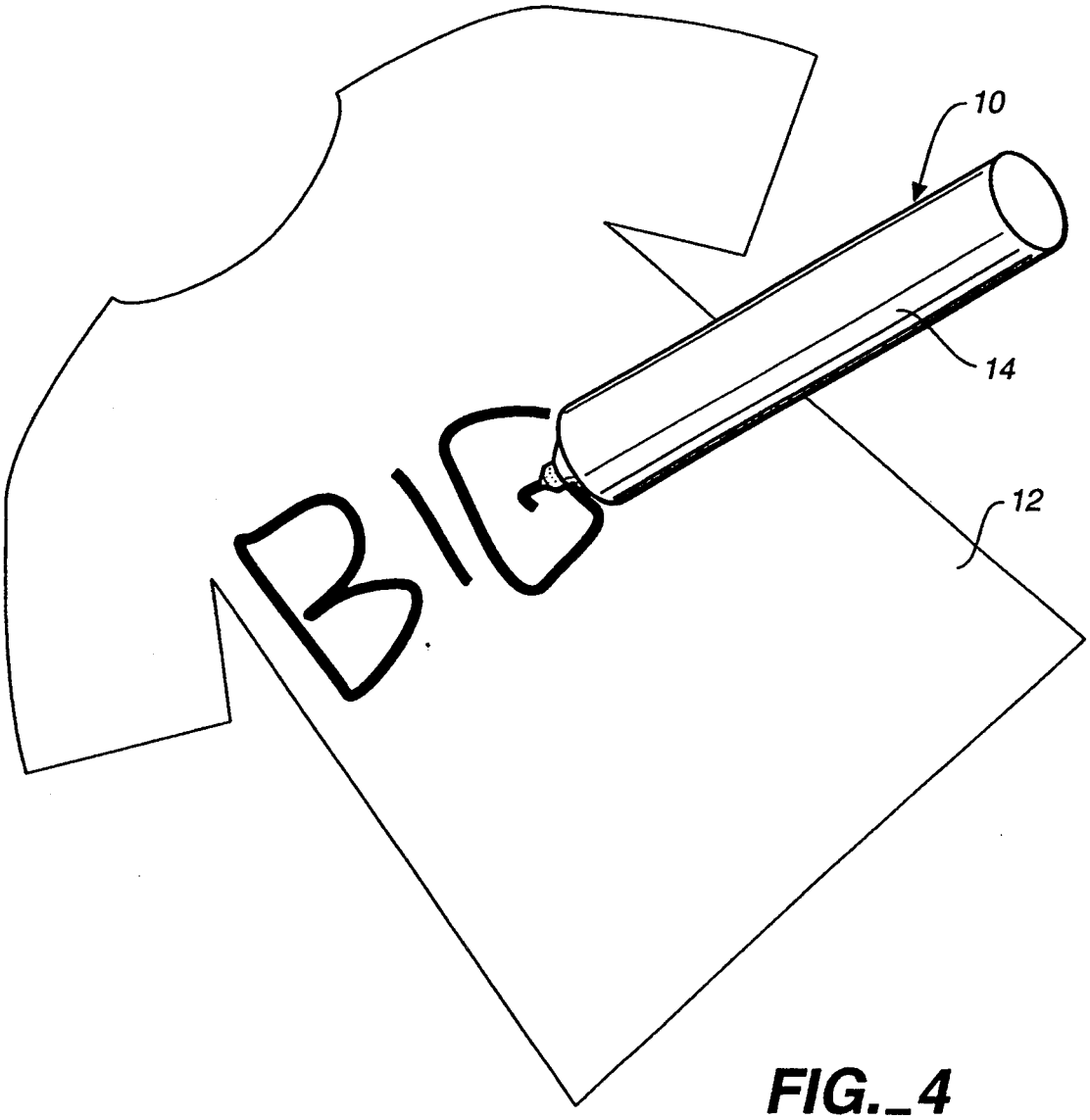
FIG. 4 is a perspective view of the apparatus being used to write on a shirt.

Referring now to the drawings, apparatus constructed in accordance with the teachings of the present invention is designated by reference numeral 10. Apparatus 10 is for applying a chemiluminescent fluid to the surface of an object such as a shirt 12 (FIG. 4). The chemiluminescent fluid may, for example, be applied to the shirt to produce writing or graphics which will glow during the active life of the chemiluminescent fluid after mixing of the components thereof.

Apparatus 10 includes an outer reservoir including a wall 14 and defining an interior for holding a first component 16 of a chemiluminescent fluid. The precise nature of the chemiluminescent fluid and the components thereof is not important; however, such materials should be nontoxic as well as non-harmful to other materials. For example, a suitable first chemiluminescent fluid component suitable for use in connection with the present invention is a mixture of Dibutyl Phthalate, CPPO (bis(2,4,5-trichloro-6-carbopentoxyphenyl)oxalate) and CBPEA (1-chloro-9,10-bis(phenylethynyl)anthracene).

A breakable or frangible capsule 20 containing the second chemiluminescent fluid component 22 is located within the interior of the reservoir as defined by wall 14. A suitable second chemiluminescent fluid component is a mixture of Dimethyl Phthalate, T-butyl Alcohol, hydrogen peroxide ($H_2O_2$), and Sodium Salicylate. The capsule 20 may, for example, be constructed of glass. As long as the capsule 20 remains unbroken, the first and second components 16, 22 are maintained in complete isolation from one another and cannot react chemically. When, however, the capsule is broken, the first and second components mix to form the chemiluminescent fluid. One approach for breaking the capsule 20 is to construct all or a portion of wall 14 of flexible material such as plastic. Bending of the wall 14 will cause the wall to engage the capsule and apply forces thereto which will result in breaking of the capsule. After mixing, the chemiluminescent fluid comprised of first and second components 16, 22, will begin to luminesce.

An end element 24 constructed of plastic or the like is secured to wall 14 in a fluid-tight manner. End element 24 in the embodiment illustrated is in the general form of a plug and defines a passageway 26 in communication with the reservoir interior.

Press-fit or otherwise secured in passageway 26 is a porous writing nib 28 having a distal end 30 for engaging an object such as shirt 12 to apply chemiluminescent fluid to the object. The distal end is spaced from reservoir wall 14 and projects outwardly therefrom.

Integrally connected to the end element 24 is a cap 32. Interconnection is accomplished by a breakable connector 34 which in the present instance is a zone of decreased wall thickness between cap 32 and end element 24. Until the apparatus is to be utilized, the cap is maintained integral with the end element; however, when dispensing is to be accomplished, the cap 32 is manually twisted and removed from the rest of the apparatus so that the porous writing nib 28 is exposed. That is, the end element, the cap and the breakable connector are of integral, unitary construction and cooperable with the reservoir wall 14 to provide a fluid-tight barrier between the reservoir interior and the ambient atmosphere until removal of the cap from the end element.

The breakable connector or reduced portion 34 surrounds porous writing nib 28 at a location closely adjacent to the writing nib and between the reservoir wall and the writing nib distal end. The cap 32 defines a recess 40 for receiving the writing nib distal end 30 when the cap is integrally connected to the reservoir wall 14. Once removed, the cap may be repositioned over the writing nib.

Figure 1:
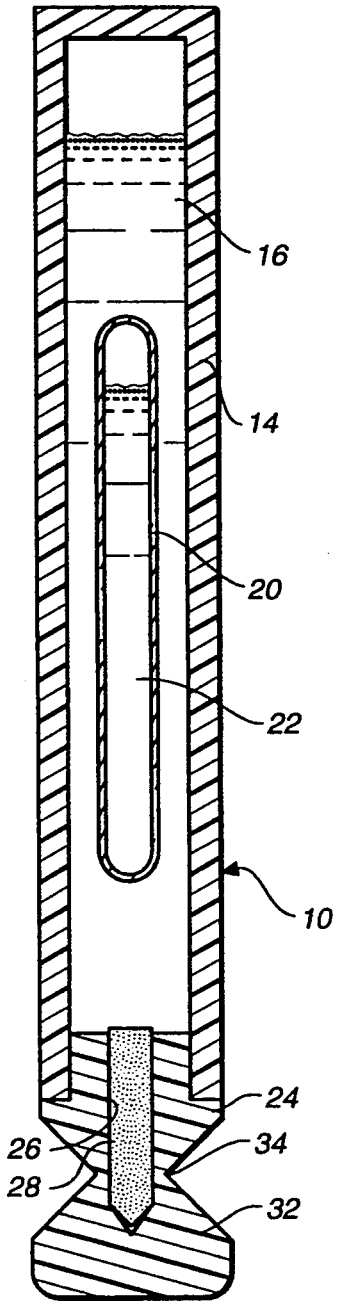
FIG. 1 is a cross-sectional view of apparatus constructed in accordance with the present invention with all components thereof intact.
Figure 2:
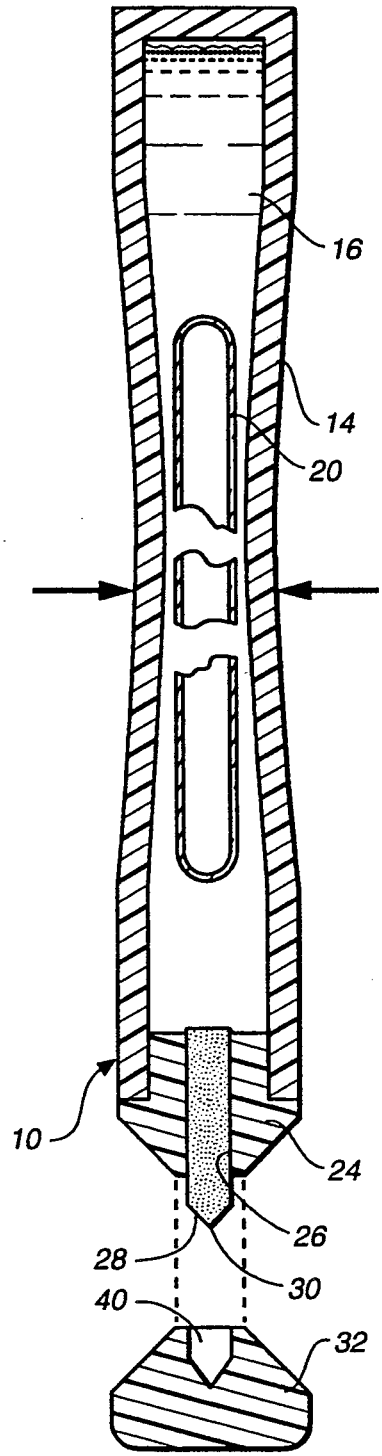
FIG. 2 is a cross-sectional view of the apparatus showing the capsule thereof being broken and a cap removed to expose a writing nib.
Figure 3:
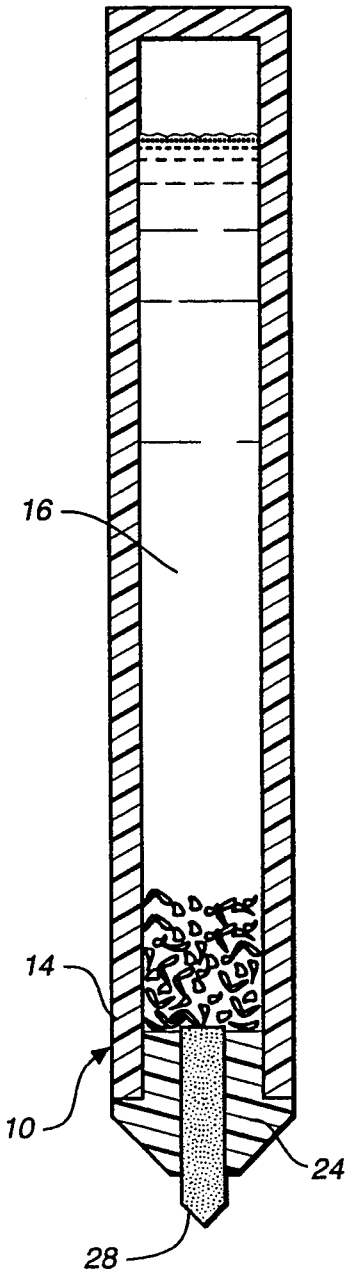
FIG. 3 is a cross-sectional view of the apparatus showing capsule fragments being blocked by the writing nib.

The writing tip or nib 28 performs a plurality of functions and must be selected with care with regard to both the shape of the writing nib and the composition thereof. One function of the nib is, of course, to provide transfer of the chemiluminescent fluid from the reservoir interior to the desired surface. The nib also serves to regulate flow of chemiluminescent fluid to the surface. A third function of the nib is to serve as a filter to screen out particulates, such as glass fragments resulting from breaking of capsule 20, that may be present in the chemiluminescent fluid. This is shown in FIG. 3.

Porous writing nib 28 also functions as a vent when the apparatus 10 is inverted with distal end 30 at the top, allowing air to replace the volume of withdrawn chemiluminescent fluid and facilitating increased fluid flow when the apparatus is returned to writing position. Venting by conventional methods such as a side port or nib channel venting would be difficult to regulate, subject to leaking, and add to complexity of the device.

One factor critical to fluid flow is the porosity of the writing nib. It has been found that proper functioning of the apparatus 10 will occur when the porous writing nib has a porosity in the range of from about 32 percent to about 74 percent, and even more particularly within the range of from about 65 percent to about 72 percent. The writing nib is also to be comprised of a porous material chemically inert with respect to the chemiluminescent fluid in the reservoir interior, the interstices of the porous material allowing flow of the chemiluminescent fluid through the writing nib in a controlled manner.

A variety of nib materials have been tested and found satisfactory for use when dispensing chemiluminescent fluid. Man-made fibers such as longitudinally bonded nylon, longitudinally bonded acrylic, longitudinally bonded polyester and porous polyethylene have been found to be particularly suitable for use as a writing nib, although other materials such as a needled wool felt may be employed to lesser advantage. While the shape of the writing nib may have variants, it has been found that a "blunt bullet" design as shown in the drawings is especially useful for applying chemiluminescent fluid to cloth and other relatively rough surfaces.

The luminescent fluid components are, during the manufacturing process, completely and hermetically sealed in a chemically inert container, i.e. the reservoir as partially defined by wall 14. In order to promote simplicity of design and provide protection for the writing nib it is enclosed in the container and necessarily contacts the first chemiluminescent fluid component 16. Thus, the writing nib must be chemically inert to the first component 16 so that neither the characteristics of the nib nor the fluid are altered.

Over time, the writing nib 28 will become saturated with the un-activated first component. After activation, it is necessary to purge the un-activated first component from the nib prior to being able to write with the activated chemiluminescent fluid, i.e. the mixed fluid. It is therefore desirable to keep the length of the writing nib to a minimum so that writing with activated or mixed chemiluminescent fluid can begin promptly. However, if the nib is too short, it may be insufficiently long to allow ease of use of the device. Additionally, if a press-fit is desired to position the writing nib in the end element 24, a very short writing nib may be subject to push-back or removal by pulling. Writing nibs as short as about ½ inch and as long as about 1 inch have been found to function properly in this capacity. It has been found that a length of ¾ inch works particularly well with respect to the above considerations. Diameter of the nib may vary, although diameters of 0.118 inch through 0.175 inch have been tested and found to present a good feel and operation when fabricated of longitudinally bonded acrylic fibers.

According to the method of the present invention, a first component of a chemiluminescent fluid is maintained in a confined space. A second component of the chemiluminescent fluid is maintained in the confined space and isolated from the first component.

The shape of the confined space is changed, for example by bending the wall 14 to break the capsule and substantially simultaneously bring the first and second components into engagement. The first and second components are then mixed. It may be advisable to shake the apparatus to promote mixing to form a mixed chemiluminescent fluid.

The mixed chemiluminescent fluid then flows through a porous writing nib communicating with the confined space and the writing nib has a distal end to which the mixed chemiluminescent fluid is delivered.

The operator brings the distal end of a porous writing nib into engagement with an object and effects relative movement between the object and the porous writing nib while maintaining engagement between the porous writing nib and the object to apply the mixed chemiluminescent fluid to the object in a desired pattern.

When the writing nib is disposed downwardly, and the mixed chemiluminescent fluid is being applied to the object, the writing nib necessarily remains in engagement with the mixed chemiluminescent fluid in the reservoir so that a continuous supply and flow will exist.

In those instances where the object is formed from cloth or otherwise has a porous surface, the mixed chemiluminescent fluid will be absorbed into the porous surface. This results in greater luminescence because there is a greater concentration of chemiluminescent fluid in a given area.

It has been found that some chemiluminescent fluid components, when combined and activated, generate gaseous pressure to at least some extent within the confines of the reservoir due to the chemical interaction between the first and second components. For example, the two components identified above, when combined, will generate a positive pressure. This will facilitate dispensing of the fluid.

As stated above, while the mixed chemiluminescent fluid is being applied by the porous writing nib, the porous writing nib forms the dual function of filtering out solid matter, such as broken glass, and maintaining such solid matter within the confines of the reservoir.

We claim:

1. Apparatus for applying a chemiluminescent fluid to an object, said apparatus comprising, in combination:

reservoir means including a wall and defining an interior for holding a first component of a chemiluminescent fluid, and said reservoir means additionally defining a passageway in communication with said reservoir means interior;

capsule means located within said reservoir means interior for holding a second component of said chemiluminescent fluid, said capsule means being frangible to release said second component of chemiluminescent fluid from said capsule means and bring said second component of chemiluminescent fluid into engagement with said first component of chemiluminescent fluid and allow mixing thereof in said reservoir means interior;

an applicator element mounted in said passageway for receiving chemiluminescent fluid from said reservoir means interior after mixing of said first and second components of chemiluminescent fluid in said reservoir means and for applying the chemiluminescent fluid to an object upon engagement between said applicator element and said object; and closure means releasably attached to said reservoir means for maintaining said applicator element and said reservoir means interior isolated from the ambient atmosphere, said applicator element comprising a porous writing nib having a distal end for engaging an object to apply chemiluminescent fluid to the said distal end being spaced from said reservoir means wall, said reservoir means additionally comprising an end element connected to the reservoir means wall, said end element defining said passageway, and said closure means comprising a cap integrally connected to said end element by a breakable connector allowing removal of said cap from said end element upon application of outside force to said cap, said breakable connector surrounding said porous writing nib at a location closely adjacent to said writing nib and between said reservoir means wall and said writing nib distal end, and said writing nib being comprised of a porous material chemically inert with respect to the chemiluminescent fluid in said reservoir means interior, the interstices of said porous material allowing flow of said chemiluminescent fluid through said writing nib and said porous material adapted to filter and prevent dispensing of solid material in said chemiluminescent fluid.

2. The apparatus according to claim 1 wherein said end element, said cap and said breakable connector are of integral, unitary construction and cooperate with said reservoir means wall to provide a fluid-tight barrier between said reservoir means interior and the ambient atmosphere until removal of said cap from said end element.

3. The apparatus according to claim 1 wherein said porous writing nib has a porosity in the range of from about 32 percent to about 74 percent.

4. The apparatus according to claim 1 wherein said cap defines a recess for receiving said writing nib distal end when said cap is integrally connected to said reservoir means wall and wherein said cap is selectively positionable over said writing nib.

5. The apparatus according to claim 1 wherein said writing nib has a length falling within the range of from about ½ inch to about 1 inch.

6. The apparatus according to claim 1 wherein said writing nib material is formed from bonded man-made fibers.

7. The apparatus according to claim 1 wherein at least a portion of said reservoir means wall is deformable upon application of outside force thereto, said capsule means being frangible responsive to deformation of said wall.

8. The apparatus according to claim 1 wherein said porous writing nib has a porosity in the range of from about 65 percent to about 72 percent.

9. A method of applying a chemiluminescent fluid to an object having a porous surface, said method comprising the steps of:

maintaining a first component of a chemiluminescent fluid in a confined space;

maintaining a second component of the chemiluminescent fluid in the confined space and isolated from said first component;

changing the shape of said confined space and substantially simultaneously bringing said first and second components into engagement;

mixing said first and second components in said confined space to form a mixed chemiluminescent fluid;

flowing said mixed chemiluminescent fluid through a porous writing nib communicating with said confined space and having a distal end to deliver said mixed chemiluminescent fluid to said distal end;

bringing said distal end of said porous writing nib into engagement with an object;

effecting relative movement between said object and said porous writing nib while maintaining engagement between said porous writing nib and said object to apply said mixed chemiluminescent fluid to said object;

absorbing mixed chemiluminescent fluid applied to said object into said porous surface;

maintaining the writing nib in engagement with mixed chemiluminescent fluid in said confined space while applying mixed chemiluminescent fluid to said object; and filtering solid matter in said confined space from said mixed chemiluminescent fluid with said porous writing nib.

10. The method according to claim 9 wherein said flowing step at least partially comprises the step of applying pressure to the mixed chemiluminescent fluid in said confined space to force mixed chemiluminescent fluid through said porous writing nib toward the writing nib distal end.

11. The method according to claim 10 wherein the step of applying pressure includes generating gaseous pressure in said confined space due to chemical interaction between said first and second components.

* * * * *